United States Patent [19]

Ng

[11] Patent Number: 4,497,566

[45] Date of Patent: Feb. 5, 1985

[54] CORRECTION OF IMAGE DEFECTS IN PHOTOCONDUCTIVE FILM

[75] Inventor: Yee S. Ng, Rochester, N.Y.

[73] Assignee: Eastman Kodak Company, Rochester, N.Y.

[21] Appl. No.: 471,947

[22] Filed: Mar. 3, 1983

[51] Int. Cl.[3] ..... G03G 15/00; G03G 5/06; B65H 17/32

[52] U.S. Cl. ..... 355/3 CH; 355/16; 430/31

[58] Field of Search ..... 355/3 CH, 3 R, 16, 133; 354/3, 154; 352/56, 130; 430/31, 71, 72, 73, 74, 95, 96, 56, 130, 136

[56] References Cited

U.S. PATENT DOCUMENTS

| | | | |
|---|---|---|---|
| 3,637,433 | 1/1972 | Sims | 117/201 |
| 3,850,631 | 11/1974 | Tamai | 96/1.5 |
| 3,887,367 | 6/1975 | Parker | 96/1 R |
| 3,930,853 | 1/1976 | Ciuffini | 96/1.5 |
| 4,141,735 | 2/1979 | Schrader et al. | 96/75 |
| 4,206,994 | 6/1980 | Silverberg et al. | 355/16 X |
| 4,301,226 | 11/1981 | Contois et al. | 430/72 |

*Primary Examiner*—John Gonzales
*Assistant Examiner*—Terry Flower
*Attorney, Agent, or Firm*—Bernard D. Wiese

[57] ABSTRACT

Image defects in liquid-developed photoconductive film, which before use has been stored in roll form at elevated temperature, are corrected by an on-line treatment of the film prior to development. The method comprises heating the photoconductive film prior to charging while under stress-relieving tension and then cooling it.

3 Claims, 2 Drawing Figures

FIG. 1
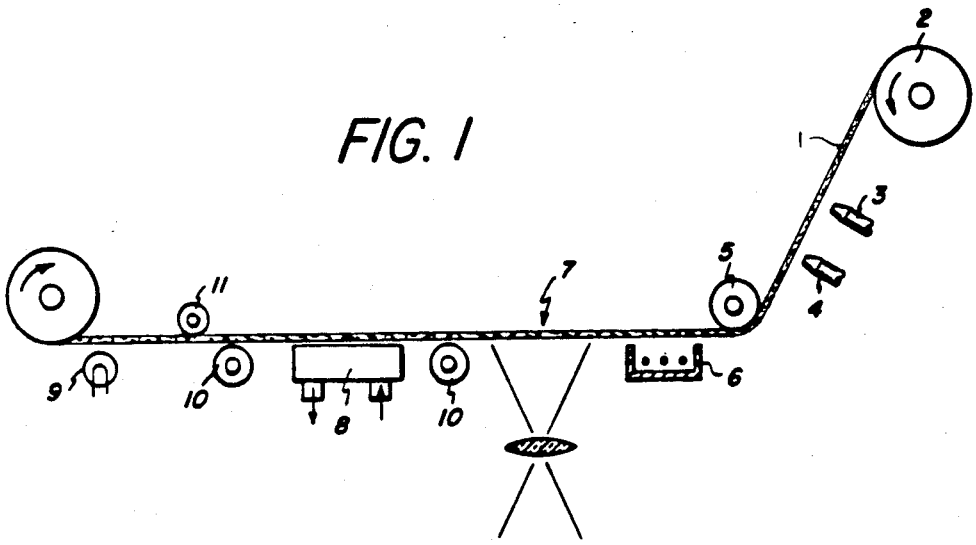
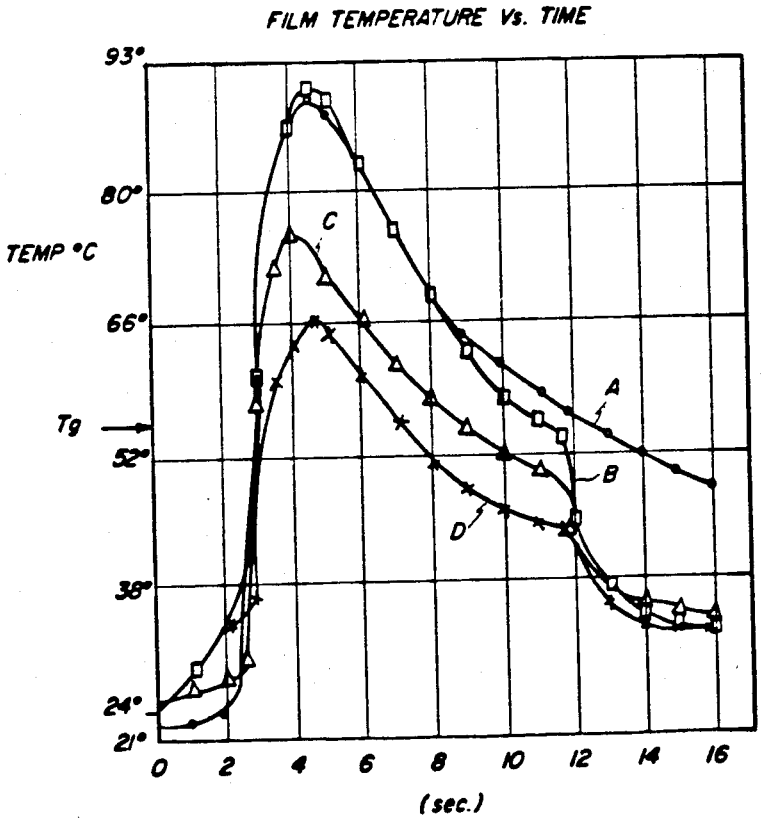
FIG. 2

CORRECTION OF IMAGE DEFECTS IN PHOTOCONDUCTIVE FILM

FIELD OF THE INVENTION

This invention relates to electrophotography and, in particular, to a method for improving the quality of images on photoconductive film.

BACKGROUND OF THE INVENTION

Processes for the formation and development of images on the imaging surfaces of photoconductive materials are well documented. These processes have in common the steps of employing a photoconductive insulating element which responds to imagewise exposure with actinic radiation (radiation which is absorbed by and effects a chemical or electrical change in a material) by forming a latent electrostatic charge image. The image is then made visible by electrically charged toner particles which are attracted to it. These toner particles are carried in a developer, which can contain either a dry or a liquid carrier. The visible image can then be transferred to a receiving sheet such as paper or it can be fused or otherwise fixed directly to the photoconductive element.

Various types of organic and inorganic photoconductive insulating elements are known for use in electrophotographic imaging processes. One particular type of photoconductive element is photoconductive recording film which comprises an organic or inorganic photoconductive compound dispersed in a polymeric vehicle to form a heterogeneous or homogeneous photoconductive insulating layer which is carried on a flexible polymeric film support. The resulting photoconductive film is stored and used in roll form. When photoconductive recording film is used, it is first sensitized by uniformly charging the surface with a corona charger. Then it is exposed to an appropriate light source and developed, for example, with a liquid developer. The image is then dried and fused directly to the surface of the photoconductive recording film.

When the photoconductive recording film is new, the resulting developed image is of good quality. It has been noticed, however, that film that has been stored in roll form for a period of time produces images with imperfections. Specifically, these imperfections consist of random parallel lines that run perpendicular to the length of the roll film. The cause of these imperfections is not readily apparent. Considerable research has been carried out to discover the causes of these defects.

After extensive testing of different hypotheses, it has been found that the combination of storage at elevated temperatures and the use of liquid developer causes the described defects.

It is now believed that elevated temperatures cause the film to creep slightly during storage. Because the film is rolled on a spool, it tends to take on a curled configuration. This phenomenon is familiar to anyone who has tried to hang wallpaper. As one attempts to unroll the paper and apply it to the wall, the wallpaper stubbornly resists, preferring instead to remain in its rolled form. Roll photoconductive film behaves in an analogous manner. This inherent tendency of roll film to acquire a "set" on aging is referred to in the art as "core-set" when the set conforms to a core or spool on which the film has been wound and stored. "Core-set" may be explained as the result of plastic flow deformation of the film when it is wound on a core and stored at ambient temperature and humidity for a period of time sufficient for the film to acquire a substantially permanent curvature in the direction of its winding on the core. Although the core-set curling tendency of the polymeric film base itself is a significant force in causing curl, and can be the controlling factor in curling tendencies of a photoconductive film roll, the presence of coated layers on the base can also cause problems. This is because each layer of the film element differs from the others in its dimensional response to moisture and heat. The varying stresses of the different layers will, therefore, tend to cause the film element to assume a flat or curved shape governed by the equilibrium of the force exerted by the layers. These stresses, and the resulting amount of curl, will change as the temperature and humidity change. Core-set increases with an increase in storage temperature.

It has also been shown that the orientation of the coated photoconductive insulating layer affects the film's propensity to crack. When the insulating layer is wound on the inward side of the film element (i.e. the side of the film that faces the core of the film spool) the film exhibits more cracking defects. The hypothesis is that during storage, free volume in the insulating layer decreases and embrittlement begins. After the film has been stored for a time at elevated temperature, it takes on a core-set and thus when it is processed the equipment subjects it to stresses that induce minute cracks in the film which are not visible to the eye. These cracks might be of little consequence at this point. But, as has now been discovered, when a liquid developer contacts the cracks, they enlarge, growing in both length and width. The liquid developer becomes entrapped in the cracks and shows up on the final image as a line.

After discovery of the cause of the defects the difficult task remaining has been to eliminate the cracking defects without affecting the other desirable qualities of the film. This had to be accomplished in a way that was both economical and easy to implement.

SUMMARY OF THE INVENTION

The present invention provides a solution to the problems described above in a type of process wherein a photoconductive film is charged to uniform polarity, the charged film is exposed to form a latent electrostatic image on its surface and is then contacted with a liquid electrographic developer to make the latent image visible. In accordance with the invention the described defects in the film are reduced or eliminated by subjecting the film to heat while it is in a stress relieving position prior to charging. By "stress relieving" position, it is meant that the film is unrolled and stretched under light tension, or is passed over a curved surface to bend the film in the opposite direction from the rolled up direction or is otherwise pulled or bent while it is being heated. In preferred embodiments of the novel method the film is heated and thereafter cooled prior to charging, exposure and contacting with a liquid developer.

BRIEF DESCRIPTION OF THE DRAWINGS

The invention will be further described with reference to the drawings of which:

FIG. 1 is schematic of an embodiment of the novel method, and

FIG. 2 is a plot of apparent film temperature versus heating and cooling time for a series of runs illustrating the novel process.

DETAILED DESCRIPTION

The present novel process can be used on any photoconductive film in which cracks develop. Because of the way the cracks are believed to come into existence, the process would most advantageously be used with films that are stored in roll form and are developed using liquid developers.

These films are made up of organic or inorganic photoconductors dispersed in a polymeric vehicle to form a heterogeneous or homogeneous photoconductive layer over a conducting layer formed on a film support. A barrier layer can also be present between the photoconductive and conducting layers. The purpose of the photoconductive layer is to accept and hold an electrostatic charge in the dark, and then to discharge in areas which are exposed to actinic radiation.

The first step in using photoconductive films is to sensitize the surface. This is done by applying a uniform electrostatic charge to the surface of the photoconductive layer by the use of a corona charger. The charging operation is carried out in the dark or under the appropriate safelight conditions for the film being used because the film becomes sensitive to light during this step. A corona charger can be as simple as a wire connected to a high-voltage source of about 6000 to 7000 volts. The corona charger produces a quantity of charged ions which are attracted to the film surface. The charging-current circuit is completed by grounding the conducting layer of the film. Grounding the conducting layer causes some of the charges of the opposite polarity to ions provided by the corona charger to flow into the conducting layer.

The resulting charge on the film depends on the initial charging voltage, the construction of the charger, and the velocity of the film passing the charger or of the charger passing the film.

When light from the exposing source strikes the charged photoconductive layer of the film, the photoconductor becomes conductive where it strikes. The light produces positive and negative charges which migrate through the photoconductive layer and discharge both the surface-layer and conducting-layer charges in a pattern that corresponds to the image. The areas not struck by the exposing light remain with their respective charges intact. It is not necessary for the exposure to reduce the surface voltage to zero.

The exposing source can be simply a moving spot of light to produce a high-contrast trace or an exposure through a high-contrast negative to produce other types of line copy. In addition, an exposing source using a modulated light beam, or an exposure to a continuous-tone subject, can be used to produce a continuous-tone image on the film.

Developing the electrostatic latent image to make it visible can be as simple as immersing the exposed material in a liquid developer. Liquid developers are easy to use and offer the advantage of forming images of high resolution because of the small particle size of the toner. In a liquid developer, toner particles are usually dispersed in an insulating hydrocarbon liquid vehicle. The toner particles acquire an electrical charge via charge agents in the developer.

When a photoconductive film with an exposed latent image in the form of a charge pattern is immersed in a liquid developer, the toner particles are attracted by, and migrate to, the latent image and are deposited there.

Once the toner particles have been laid down on the surface of the photoconductor, the developed image is fixed, for example, by applying heat to melt or fuse the toner particles to the surface for a permanent image. During the fusing process, the toner also melts slightly into, and fuses with, the material of the photoconductive layer thereby adding to the durability of the finished image.

A balance of heat is required to produce the required degree of softening without distorting the base. Fusing temperatures preferrably range between 75° and 110° C. With further increases in temperature, there is some tendency toward distortion of the film.

The improvement in image quality achieved by the method of the invention as compared with conventional processing of photoconductive films is obtained by heating the film prior to charging while it is in a stress relieving position. This reduces or eliminates the problem of cracking defects. The key to the novel process is to heat the film to a temperature above the glass transition temperature, Tg, for a sufficient length of time to allow the film to soften and the cracks to anneal. The heating of the film may be carried out in any convenient manner. Hot air may be blown on the film. The film may be passed over a heating roller. Another possibility is to expose the film to a radiant heat source.

To aid in the understanding of the invention, the term "glass transition temperature" as used herein is described in greater detail. At sufficiently low temperatures all amorphous polymers or amorphous regions of semicrystalline polymers assume characteristics of glasses, such as hardness, stiffness and brittleness. Polymers in the glassy state are characterized by a low volume coefficient of expansion, when compared with that of the polymer in the fluid state. In this respect polymers in the glassy state resemble crystalline polymers which are also characterized by a low volume coefficient of expansion. The temperature interval at which the volume coefficient of expansion of the amorphous polymer changes from a high to a low value is the glass transition temperature range. The glass transition temperature of a polymer cannot be defined as a specific temperature, although this is frequently done in the literature. In fact, the glass transition temperature of a polymer is rate-dependent, i.e., it is dependent on the rate of heating or cooling of the polymer during the analytical determination of the volume coefficient of expansion. The faster the rate of heating or cooling of the polymer during analysis, the wider will be the range of glass transition temperature. The opposite relationship pertains when the sample is heated or cooled slowly. In view of this rate dependence, specific glass transition temperatures refer to the midpoint of the glass transition temperature range.

The above-mentioned physical properties of amorphous polymers are the result of the fact that large-scale motions of the chains of a polymer below its glass transition temperature range cannot take place to any great extent. However, although the glassy polymer is not fluid, its chains retain some residual segmental mobility. For a discussion of the phenomenon of the "glass transition temperature" of polymers, see e.g. pages 198–204 of F. W. Billmeyer, Jr., Textbook of Polymer Science, Interscience Publishers, Division of John Wiley and Sons, N.Y. (5th printing, August 1970).

After the film has been heated long enough for the defects to cure, it is desirable to cool the film before charging. This may be accomplished in any number of ways, such as by blowing cool air on the film or passing the film over a chilled roll.

A specific embodiment of the method of the invention is described in the following example.

EXAMPLE

Before using it, a 16 mm roll of photoconductive recording film having a layer of an organic photoconductor in a resin binder was incubated at 49° C. for two hours with the photoconductive side rolled inwardly. The film was of the type disclosed in Example 7 of U.S. Pat. No. 4,301,226. Its photoconductive layer had a Tg of about 55° C.

The method of the invention was carried out with an apparatus of the type shown in FIG. 1. The film 1 was unwound from the roller 2 and passed the thermal conditioning station consisting of a hot air blower 3 and a cool air blower 4. Blower 3 directed a stream of hot air on the photoconductor side of the film as it passed. Blower 4 directed a stream of room temperature air on the film before the photoconductive film entered the corona charging station. The film then passed under a 2.5 cm diameter roller 5 and was processed by the corona charger 6, the exposure station 7, the development station 8 and the fusing station 9. It also passed over two more 2.5 cm diameter rollers 10 and one 1.25 cm roller 11. Processing conditions were: film velocity=1.27 cm/sec; film tension=125 gm/linear cm; 60° angle of film wrap on the 2.5 cm diameter roller 5 preceding charging station 6 and 25° angle of film wrap on roller 11 following development.

The apparent film temperature was measured by a thermocouple attached to the film photoconductive surface. Referring to FIG. 2, Curve A shows the apparent film temperature versus time for a film that was treated with a stream of air at 100° C. without cooling. Curves B, C and D show the apparent film temperature versus time for film that has been heated with air at 100°, 90° and 70° C., respectively, and then cooled by a stream of air at room temperature. During normal processing, the thermocouple was removed from the photoconductive film.

A 24× magnification of a photoconductive film frame processed without turning on the thermal conditioning station showed numerous cracks. With the thermal conditioning station turned on to an equilibrium hot air temperature of 100° C., almost all of the cracks were eliminated. At 90° C. more than 95% of the cracks were eliminated. At 70° C. only 60–70% of the cracks were eliminated. The thermal conditioning station does not appear significantly to affect film sharpness, resolution or sensitivity within the temperature range tested.

The invention has been described in detail with particular reference to preferred embodiments thereof, but it will be understood that variations and modifications can be effected within the spirit and scope of the invention.

We claim:

1. In a method of forming an image on a photoconductive roll film having a photoconductive layer deposited on a conductive support, which comprises:

(a) charging said photoconductive film to uniform polarity;

(b) exposing said photoconductive film to actinic radiation, thereby dissipating the charge in the exposed areas and forming a latent electrostatic image; and (c) developing said image on said photoconductive film by contacting the exposed element with an electrophotographic liquid developer, the improvement comprising:

heating the photoconductive layer of said film while it is under stress relieving tension and prior to charging, to a temperature above Tg, the glass transition, of said photoconductive layer for a time sufficient to relieve core-set and reduce cracking defects in the photoconductive roll film.

2. The method of claim 1 further comprising the step of cooling said film subsequent to heating and prior to charging.

3. The method of claim 1 or 2 in which said heating is accomplished by a stream of hot air and said cooling is accomplished by a stream of cool air.

* * * * *

UNITED STATES PATENT AND TRADEMARK OFFICE

CERTIFICATE OF CORRECTION

PATENT NO. 4,497,566

DATED February 5, 1985

INVENTOR(S) Yee S. Ng

It is certified that error appears in the above-identified patent and that said Letters Patent are hereby corrected as shown below Column 6, line 33, in Claim 1, after "transition" insert --temperature--.

Signed and Sealed this

Sixth Day of August 1985

[SEAL]

*Attest:*

DONALD J. QUIGG

*Attesting Officer* *Acting Commissioner of Patents and Trademarks*